US009566530B2

(12) United States Patent
Sheets

(10) Patent No.: US 9,566,530 B2
(45) Date of Patent: Feb. 14, 2017

(54) NATURAL LOOKING PUPPET DEVICE

(71) Applicant: Todd C. Sheets, Vancouver, WA (US)

(72) Inventor: Todd C. Sheets, Vancouver, WA (US)

( * ) Notice: Subject to any disclaimer, the term of this patent is extended or adjusted under 35 U.S.C. 154(b) by 90 days.

(21) Appl. No.: 14/621,392

(22) Filed: Feb. 13, 2015

(65) Prior Publication Data

US 2016/0236105 A1 Aug. 18, 2016

(51) Int. Cl.
*A63H 33/00* (2006.01)
*A63H 3/14* (2006.01)

(52) U.S. Cl.
CPC ..... *A63H 3/14* (2013.01)

(58) Field of Classification Search
USPC ..... 446/26, 27, 28, 327, 328, 329, 366–369,446/372, 390, 391, 395; 2/422; 434/258, 260; 472/70, 81, 84
See application file for complete search history.

(56) References Cited

U.S. PATENT DOCUMENTS 1,641,175 A 9/1927 Lemieux
2,795,896 A 6/1957 Snyder
3,526,990 A 9/1970 Edmonds
4,280,292 A 7/1981 Hills
4,304,065 A 12/1981 Baiera
4,723,323 A * 2/1988 Wright, Jr. ..... A41B 13/10 2/244
4,824,097 A * 4/1989 Axtell ..... A63H 3/14 446/26
4,975,987 A * 12/1990 Teachout ..... A41D 27/08 2/244
5,037,304 A * 8/1991 Harper ..... G09B 19/0076 2/323
5,071,114 A * 12/1991 Persaud ..... A63J 21/00 472/52
5,394,565 A * 3/1995 Stewart ..... A41D 11/00 2/108
5,558,550 A * 9/1996 Setteducati ..... A63H 37/00 446/236
5,643,037 A * 7/1997 Altschul ..... A63H 3/36 446/28

(Continued)

FOREIGN PATENT DOCUMENTS

GB 1515100 A 6/1978

OTHER PUBLICATIONS

"Rod Hull and Emu—How to Groom an Emu" (uploaded Apr. 24, 2013—viewable at https://www.youtube.com/watch?v=3De6sBNyoq8) [retrieved online Jul. 1, 2016].*

*Primary Examiner* — Kurt Fernstrom
(74) *Attorney, Agent, or Firm* — Frontier Patent Services; Joel C. Solbach

(57) ABSTRACT

The attachment between a puppeteer and a puppet is often ridged and fixed. The result is a puppet that does not look natural in some positions and movements and does not allow the puppeteer the flexibility to change articles, such as costumes or clothing, which are attached to the puppet. Methods and articles are described for creating natural looking puppet devices. These methods and devices allow illusion articles, such as a fake arm, to slide so as to have natural looking contact between the puppeteer and the puppet. The methods and articles also include means for reversible attachment of the puppet from the rest of the puppet device. The result is a puppet that has natural looking positions and movements and allows puppeteer the flexibility to make changes to the articles attached to the puppet.

9 Claims, 7 Drawing Sheets

(56) References Cited

U.S. PATENT DOCUMENTS

| | | | | |
|---|---|---|---|---|
| 6,173,450 | B1 * | 1/2001 | Hari | A41D 1/00 2/69 |
| 6,513,167 | B1 * | 2/2003 | Cheng | A45D 8/36 2/171 |
| 8,696,400 | B2 * | 4/2014 | Fair | A63H 33/006 24/581.1 |
| 8,911,278 | B2 * | 12/2014 | Hoyo | A63J 19/006 446/327 |
| 8,919,354 | B2 * | 12/2014 | Davis | A45D 8/36 132/275 |

* cited by examiner

NATURAL LOOKING PUPPET DEVICE

BACKGROUND

The present invention described herein relates to a process, method and device and generally relates to toys and novelties and, more particularly, is concerned with an illusion device that can be used by a puppeteer and can be usable in conjunction with a puppet. Puppets adapted to be positioned over the forearm and hand of a puppeteer and manipulated by the puppeteer's hand and fingers have long been known in the art. Some representative examples of puppets of this type are the ones disclosed in U.S. patents to Lemieux (U.S. Pat. No. 1,641,175) and Snyder (U.S. Pat. No. 2,795,896). Puppets of this general type share one common characteristic in that no attempt is made to hide the fact that the puppeteer's forearm is supporting the puppet and his or her hand and fingers are being used to manipulate or animate the puppet.

More recently, several puppets have appeared which share a characteristic that is just the opposite of those mentioned above. Specifically, these puppets attempt to intentionally create the illusion that the puppeteer's hand is being used solely to grasp the puppet or his or her arm is being used solely to support an object upon which the puppet is standing. Thus, the appearance or illusion projected to witnesses by these puppets is that the puppeteer's hand or arm cannot possibly be the means by which the puppet is being manipulated and so a mystery is created as to how the puppet is being worked.

Puppets having this characteristic in common are disclosed in US. Patents to Baiera (U.S. Pat. No. 4,304,065), Edmonds (U.S. Pat. No. 3,526,990) and Axtell (U.S. Pat. No. 4,824,097). In addition, Rod Hull and his crazy bird Emu were hugely popular on British TV in the 70's and 80's. Hull's puppet was aided by the simple yet effective illusion from a fake arm attached to his jacket, which cradled the emu, therefore making it appear that the neck and head moved of its own volition. Furthermore, HouseHaunters sells costumes that come with puppets where a long-sleeve costume worn by the puppeteer serves as part of a fake arm. This creates the illusion that these puppets are being held by the puppeteer while the puppeteer's real arm is actually being used to manipulate the puppet. Furthermore, Kaelin and Dunn (G.B. Pat. No. 1515100A) describe a puppet doll where the puppeteer can place his or her real hands into the puppet from behind the puppet while fake hands from the puppeteer, which are attached to the puppets dolls shoulders, give it the appearance of being held.

Puppets with these illusion designs certainly take a step in the right direction toward increasing the entertainment quality or value of the puppets in general. However, the parts that make up the illusion, such as the attachment point between the puppet and puppeteer's clothing are made immovable and ridged. The result is a puppet that cannot always have a natural looking position or movement. Furthermore, the lack of a detachable means between the puppet and the puppeteer's clothing, makes it difficult for the puppeteer to change the clothing worn while wearing the puppet and does not give the puppeteer the option of switching to a different arm to manipulate the puppet.

In some embodiments of the present invention the problems mentioned above are overcome. These and other advantages will become apparent to those skilled in the art upon a reading of the following detailed description when taken in conjunction with the drawings wherein there is shown and described an illustrative embodiment of a puppet-fake arm device.

BRIEF SUMMARY

The invention described herein relates to a puppet wherein the puppet may contain an article that is able to slide its attachment position on a puppet while retaining its contact with the puppet so as to give the article a natural looking sliding movement with respect to the puppet. In some embodiments, the article may be a fake arm which is attached to the puppet. Furthermore, the fake arm may be part of the puppeteer's clothing or costume. The fake arm may also be filled with material comprised of cloth and may include shoulder pads to give a more natural look to the overall puppet-fake arm device. In some embodiments, the attachment means may be achieved via a magnetic or paramagnetic attraction between the article and the puppet. For example, the attachment of the article may be via a magnet and a metal plate. Furthermore, in some embodiments, a groove in the puppet may be used to help guide the movement of the article with respect to the puppet. In some embodiments, the article may further include a detachable means.

Embodiments of the present invention may include a method of using a puppet. In some embodiments, one may obtain a puppet which may contain an article that is able to slide its attachment position on the puppet while retaining its contact with the puppet. For example, a fake arm and magnetic attraction between the fake arm and puppet. Next, the puppeteer may hold and manipulate the puppet in such a way that the fake arm can slide its attachment position in one or more directions while retaining an attachment to the puppet surface, with the result being a natural looking and moving puppet with a fake arm attachment. In some embodiments, the method may include the puppeteer obtaining a puppet with reversible attachments to the puppeteers clothing or costumes and, thereby, allowing the puppeteer to change clothing or costumes. Furthermore, this embodiment may include a method for changing the side or position with respect to the puppeteer's body by reattaching the puppet to a different side or part of the clothing using these reversible attachments. Furthermore, the reversible attachment may allow the puppeteer to change puppets while keeping the same clothing or costume.

DETAILED DESCRIPTION

Figure 1:
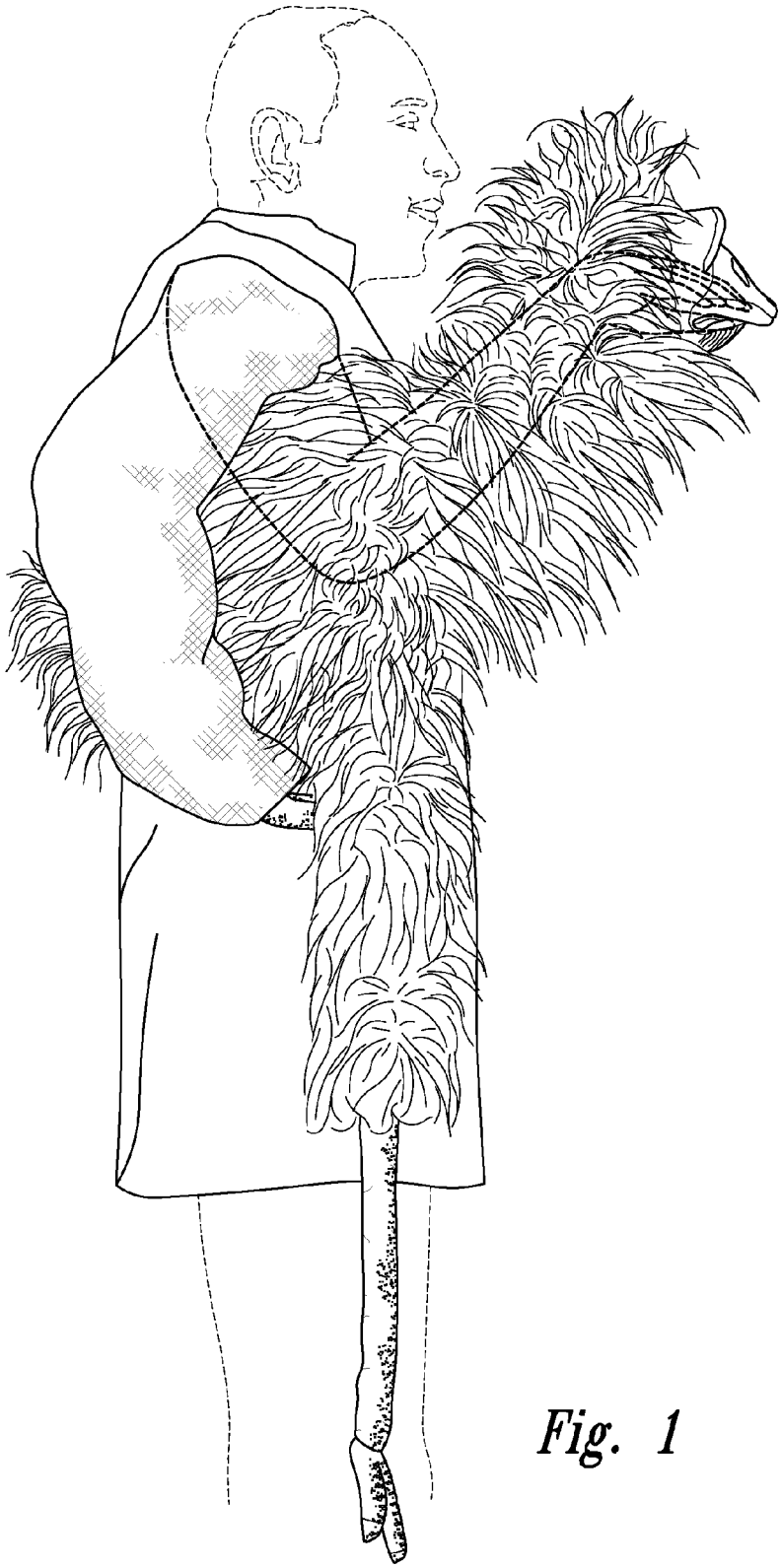
FIG. 1 shows a right side view of a puppet with a puppeteer's fake arm.
Figure 2:
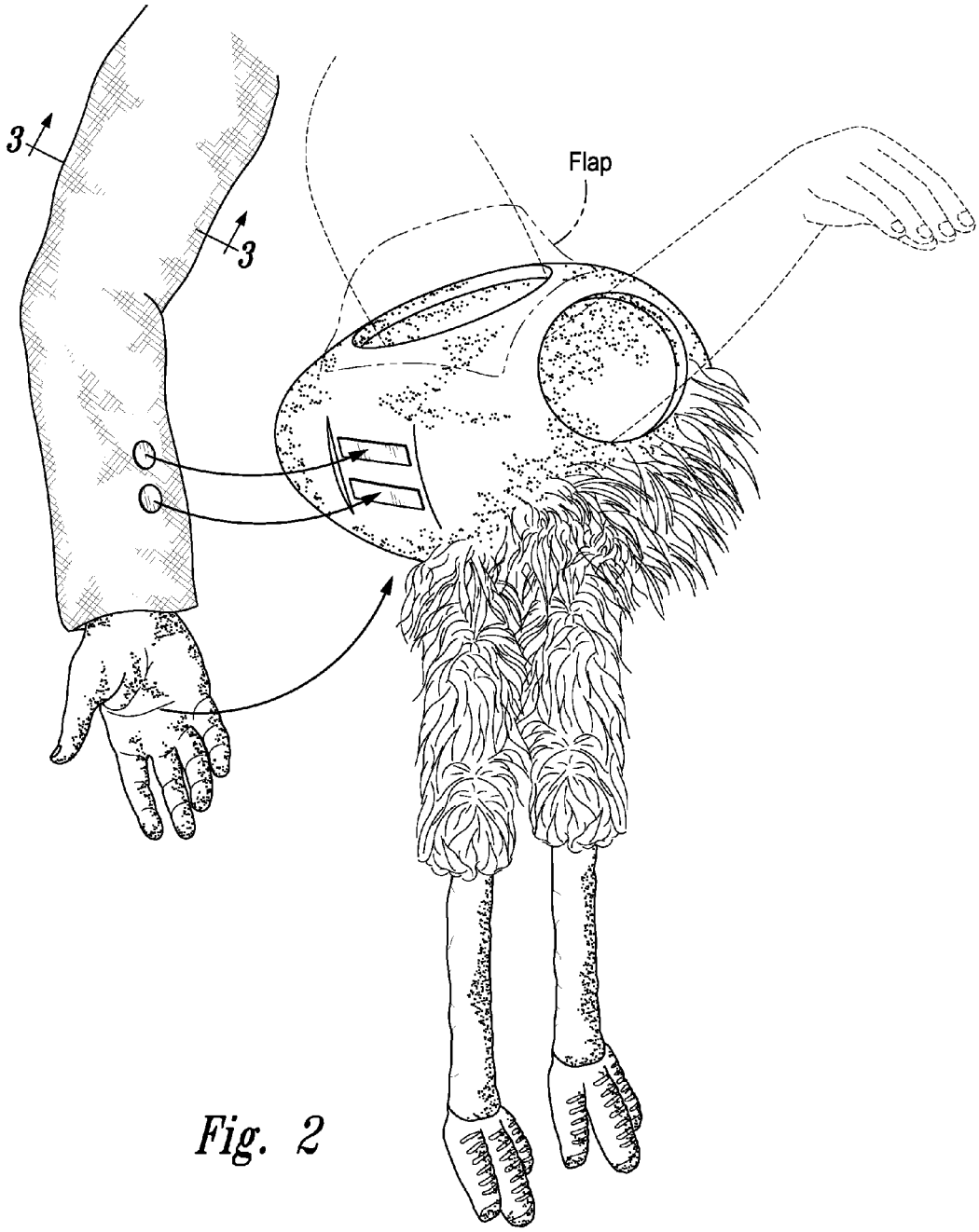
FIG. 2 shows a fake arm with magnets on the sleeve of the puppeteer's fake arm and metal magnet plates on the puppet.

In general, embodiments of the puppet device as described herein relates to a puppet wherein the puppet may contain an article that is able to slide its attachment position on the puppet while retaining its contact with the puppet so as to give the article a natural looking sliding movement with respect to the puppet.

The article refers to a means of contact between the puppeteer and the puppet. In some embodiments, the article may be a puppeteer's fake arm which is attached to the puppet. The fake arm may be part of the puppeteer's clothing or costume. In some embodiments, the article may be some other part of the puppeteer's clothing or costume. In some embodiments, the article may be part of the puppet such as an arm or a leg that is part of the puppet figure. In some embodiments, the article could be a direct contact point between the puppet and the puppeteer's clothing or costume.

In some embodiments, the article, such as a puppeteer's fake arm, may contain filler material. The filler material may be comprised of foam. Further, the filler material may be comprised of pillow filler material such as feathers or cotton. In some embodiments, the fake arm may be comprised of a hollow tube. In some embodiments, shoulder pads may be used to give a more natural look to the overall puppet-fake arm device. In some embodiments, a groove in the puppet may be used to help guide the movement of the article with respect to the puppet. Furthermore, the groove may be in the form of a half pipe.

In some embodiments, the article may be reversed so that the article may protrude from the puppet and the sliding attachment position is on the puppeteer.

In some embodiments, the attachment means may be achieved via a magnetic or paramagnetic attraction between the article and the puppet. For example, the attachment of the article may be via a magnet or magnets and a metal plate, or between two magnets. Furthermore, the magnets and plates may be covered with material to hide the magnets and plates so that the magnetic or paramagnetic attraction occurs through the covering material. In some embodiments, the magnets and/or plates may be mounted on rigid surfaces so that they stay in place. This will prevent the wrong attachments taking place. For example, if there is more than one magnet on a fake arm sleeve, those magnets may stick to each other instead of creating an attachment to the puppet.

In some embodiments, the article may include a detachable means from the puppet. The detachable means may include a button, snap, zipper, Velcro or similar reversible attachments. Furthermore, the reversible means may include a magnetic or paramagnetic attraction such as between a magnet and a metal plate. The reversible attachment may allow the puppeteer to change his or her clothing or costume and still use the same puppet. Furthermore, the reversible attachment may allow the puppeteer to change puppets while keeping the same clothing or costume. Furthermore, the reversible attachment may allow the puppeteer the option to hold the puppet on either side of his or her body.

Embodiments of the invention may include a method of using a puppet. In some embodiments, one may obtain a puppet which may contain an article that is able to slide its attachment position on the puppet while retaining its contact with the puppet. For example, a fake arm and magnetic attraction between the fake arm and puppet. Next, the puppeteer may hold and manipulate the puppet in such a way that the fake arm can slide its attachment position in one or more directions while retaining an attachment to the puppet surface, with the result being a natural looking and moving puppet with a fake arm attachment. In some embodiments, the method may include the puppeteer obtaining a puppet with reversible attachments to the puppeteers clothing or costumes and, thereby, provide the puppeteer with a method to change clothing or costumes while keeping the same puppet. Furthermore, these reversible attachments may provide the puppeteer a method for changing the side or position with respect to the puppeteer's body by reattaching the puppet to a different side or part of the clothing, and for changing puppets using these reversible attachments.

One of ordinary skill in the art would recognize many variations, modifications, alternatives and aspects of the methods and devices shown and described in the present disclosure.

Example

Figure 3:
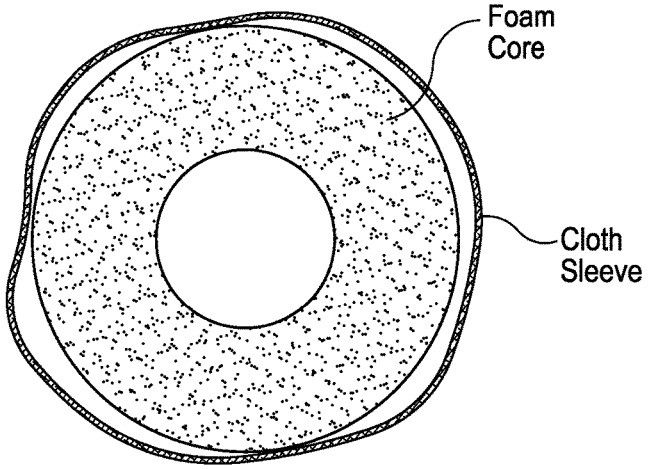
FIG. 3 shows a cross section of a puppeteer's fake arm.
Figure 4:
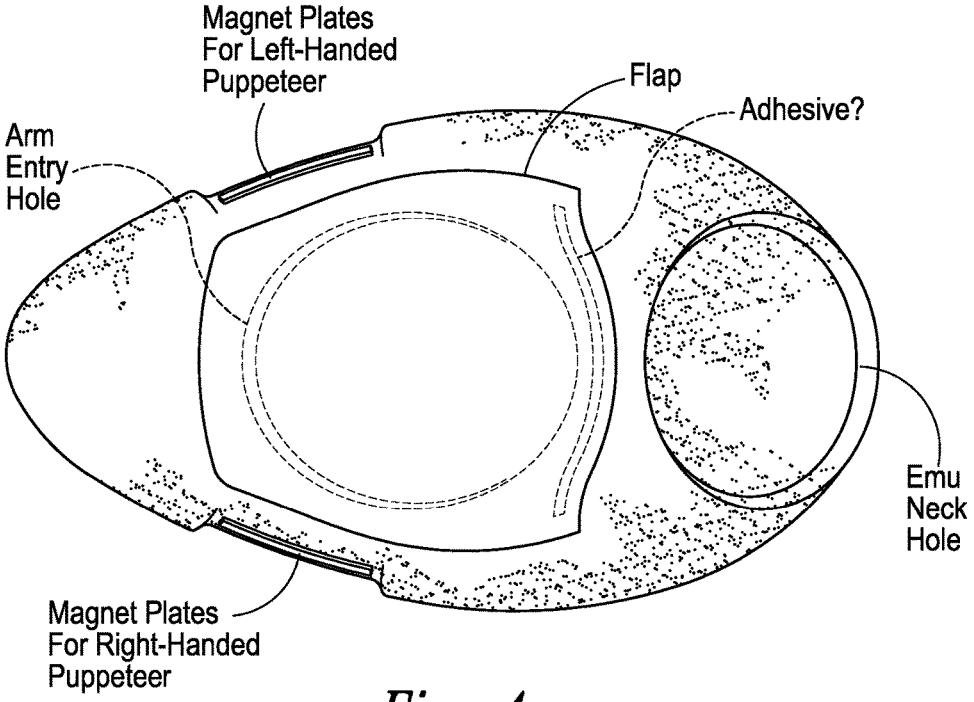
FIG. 4 shows a device inside the puppet that secures the magnet plates for the puppeteer's fake arm attachment and allows the puppeteer to insert his or her real arm through the puppet.
Figure 5:
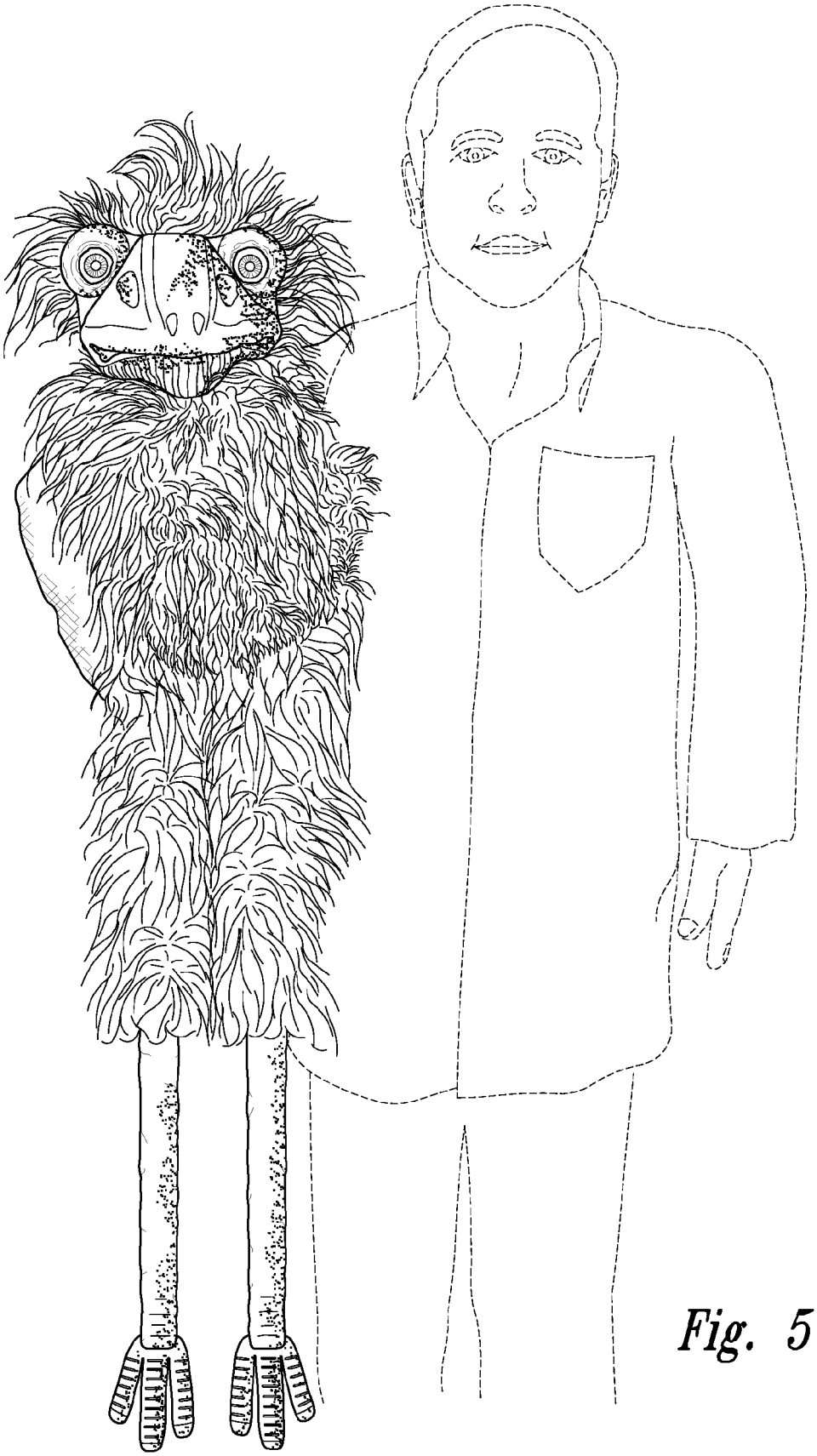
FIG. 5 shows a front view of the puppet with a puppeteer's fake arm.
Figure 6:
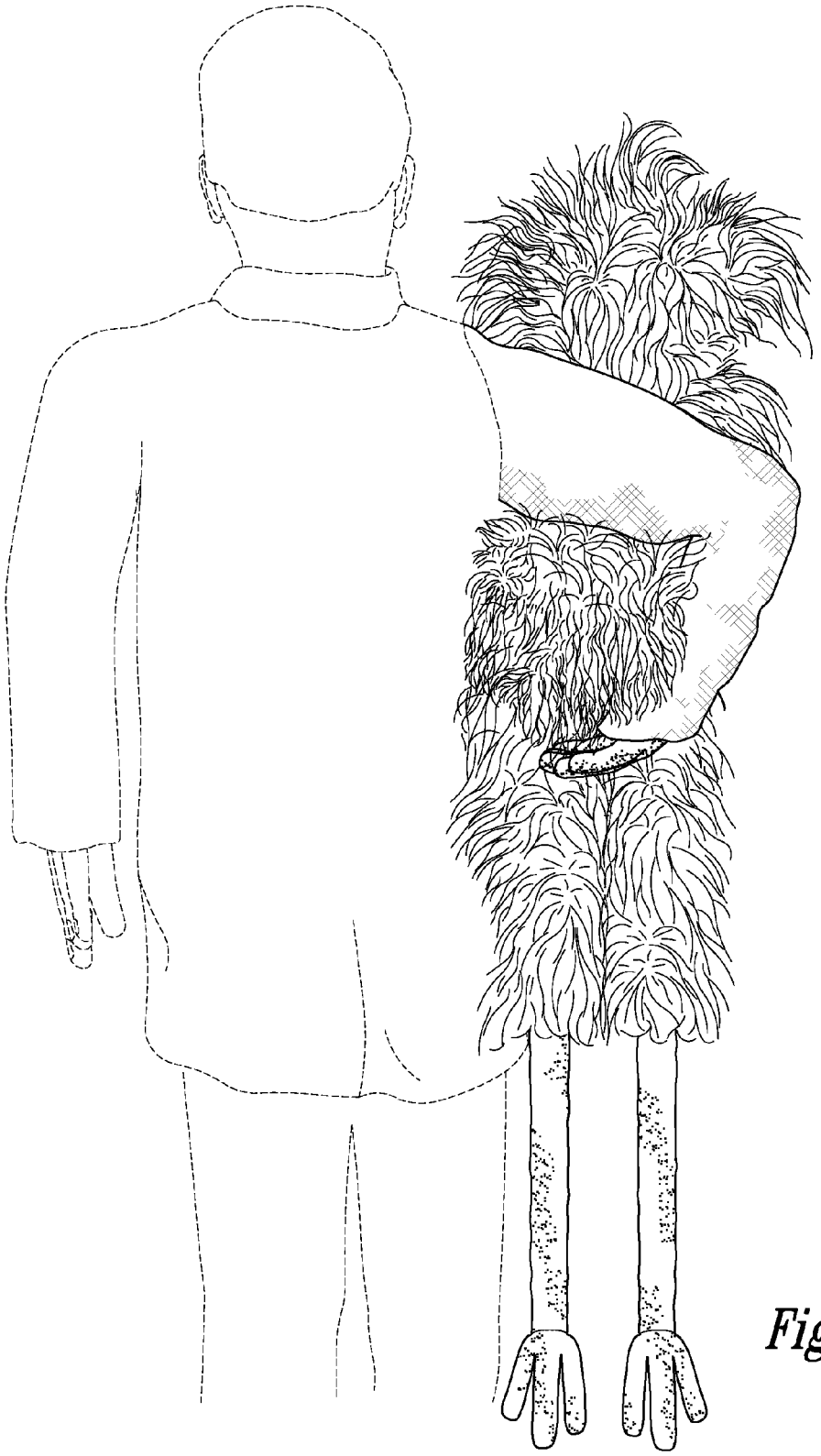
FIG. 6 shows a rear view of the puppet with a puppeteer's fake arm.
Figure 7:
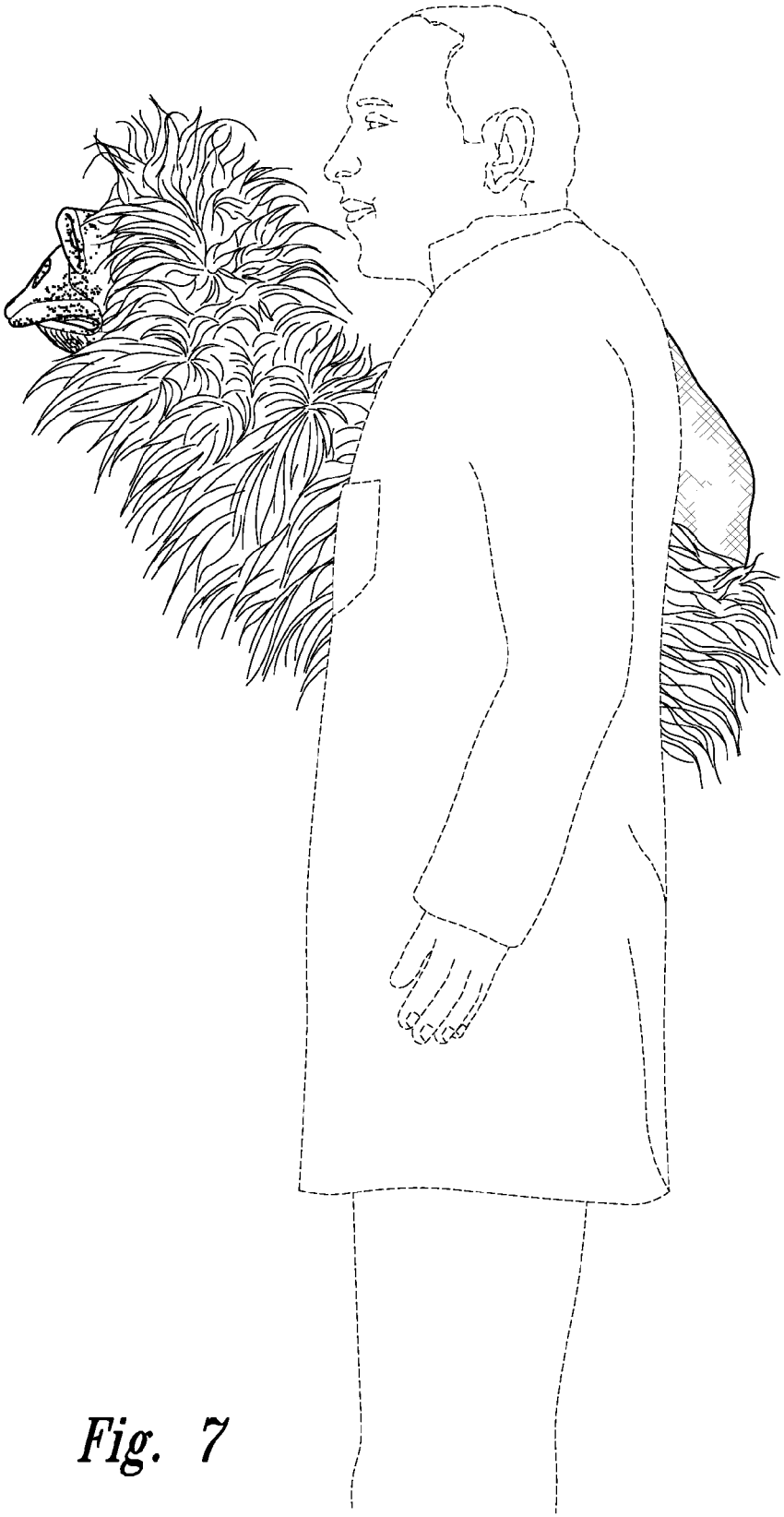
FIG. 7 shows a left side view of a puppet with a puppeteer's fake arm.
Figure 8:
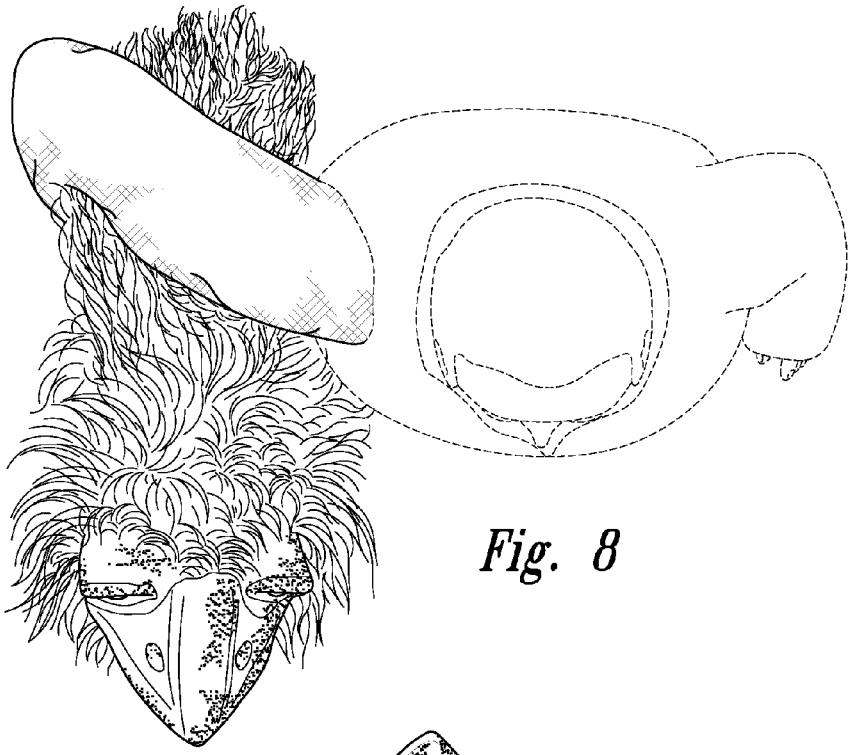
FIG. 8 shows a top view of a puppet with a puppeteer's fake arm.
Figure 9:
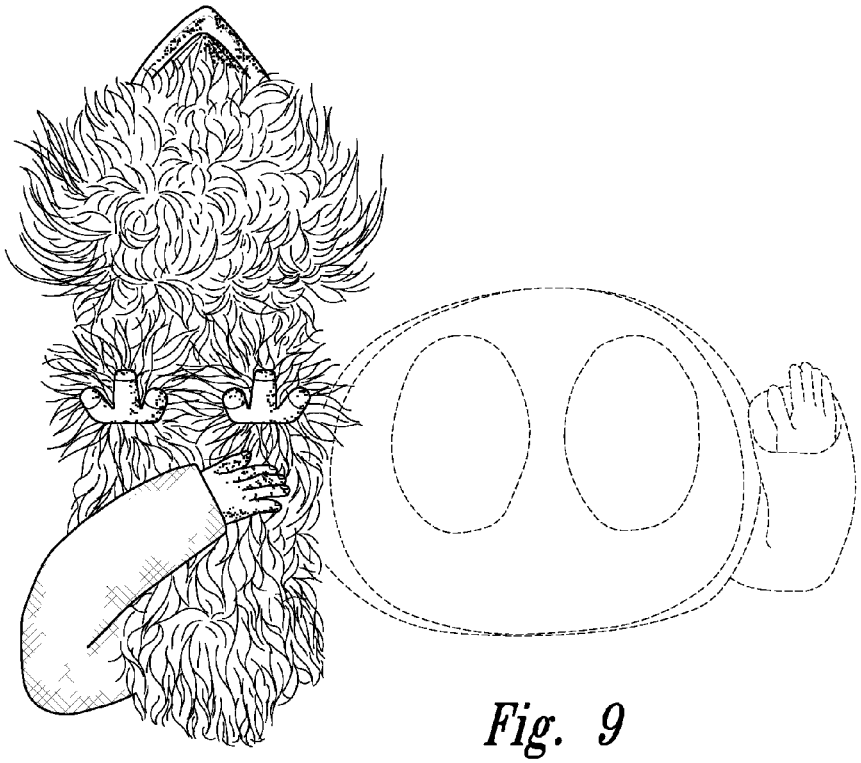
FIG. 9 shows a bottom view of a puppet with a puppeteer's fake arm.

The embodiments shown in FIGS. 1-9, are of an arm puppet-fake arm device in the form of an emu. The puppet-fake arm device give an illusion that the puppet is being held under the puppeteer's arm. To get this effect, the puppeteer's arm passes through the puppet body and a display support inside the puppet, and through the neck with the hand slipping into the bird's beak. A fake arm over the top of the puppet body gives the illusion the puppet is being held under the puppeteer's arm (FIG. 1). Magnets on the sleeve of the fake arm attach to metal plates that are mounted on the display support inside the puppet (FIG. 2) The metal plates are covered with feathers to hide them from view. The hand on the fake arm is glued to the sleeve to keep it in place close to the puppet. A groove in the puppet and display support help to hold the fake arm in place. In this example embodiment, the fake arm is filled with a foam tube to make it appear that the puppeteer's real arm is inside (FIG. 3). The puppet-fake arm device is built around a hollow display support (FIG. 4). The display support allows the puppeteer to pass his or her arm through the puppet body and hold up the puppet. In this example embodiment, the display support has metal plates mounted on both sides of the puppet so that the puppet can be held on either side of the puppeteer's body. This allows the puppet to be used by both left and right handed puppeteers.

One of ordinary skill in the art would recognize how to make and use the method and devices described.

Although certain embodiments and examples have been described herein, it will be understood by those skilled in the art that many aspects of the methods and devices shown and described in the present disclosure may be differently combined and/or modified to form still further embodiments. Additionally, it will be recognized that the methods described herein may be practiced using any device suitable for performing the recited steps. Such alternative embodiments and/or uses of the methods and devices described above and obvious modifications and equivalents thereof are intended to be within the scope of the present disclosure. Thus, it is intended that the scope of the present invention should not be limited by the particular embodiments described above, but should be determined only by a fair reading of the claims that follow.

What is claimed is:

1. A puppet comprising:

an arm-mounted display support capable of partially or wholly supporting said puppet; said arm-mounted display support having an attachment to an article attached between its self and the puppeteer; said arm-mounted display support capable of allowing said article to slide its attachment position in one or more directions while retaining said attachment to said article and with said article capable of sliding as a self-adjustment as a result of movement of said puppet and/or said puppeteer, giving the movement between said puppeteer and said puppet a natural look.

2. The puppet of claim 1, wherein said attachment of said article to said arm-mounted display support is caused by magnetic or paramagnetic attraction.

3. The puppet of claim 1, wherein said article's movement is further guided by a groove in said arm-mounted display support.

4. The puppet of claim 1, wherein said article is a fake arm.

5. The puppet of claim 4, wherein said fake arm is part of the puppeteer's costume or clothing.

6. The puppet of claim 4, wherein said fake arm's said attachment to said arm-mounted display support has a detachable and re-attachable means.

7. The puppet of claim 4, wherein portions of said fake arm are further filled with material comprised of cloth or foam.

8. The puppet of claim 4, wherein said fake arm is further comprised of one or more shoulder pads.

9. A method of using a puppet, the method comprising:

providing a puppet device having an arm-mounted display support and an article attached via a magnetic attraction between said article and said display support;

manipulating said puppet in such a way that said article can slide its attachment position in one or more directions while retaining an attachment to the surface of said arm-mounted display support giving a natural look to said attachment between said article and said puppet.

* * * * *